US005619744A

United States Patent [19]

Tebo

[11] Patent Number: 5,619,744

[45] Date of Patent: Apr. 8, 1997

[54] FILM PROCESSOR

[76] Inventor: Michael E. Tebo, 18884 Auten Rd., South Bend, Ind. 46637

[21] Appl. No.: 531,779

[22] Filed: Sep. 21, 1995

[51] Int. Cl.[6] ..... G03D 3/08; G03D 13/10

[52] U.S. Cl. ..... 396/621; 396/652

[58] Field of Search ..... 354/308, 315, 354/319, 320, 340, 344, 345, 346, 347

[56] References Cited

U.S. PATENT DOCUMENTS

| | | | |
|---|---|---|---|
| 3,672,289 | 6/1972 | Kelso | 354/322 |
| 3,683,781 | 8/1972 | Allen | 354/331 |
| 4,011,573 | 3/1977 | Braico | 354/345 X |
| 4,112,452 | 9/1978 | Patton | 354/340 X |
| 4,475,799 | 10/1984 | Castellarin | 354/308 |
| 4,607,930 | 8/1986 | Castellarin | 354/322 |
| 5,005,036 | 4/1991 | Wilson | 354/322 |

*Primary Examiner*—D. Rutledge
*Attorney, Agent, or Firm*—Baker & Daniels

[57] ABSTRACT

A film processor includes a cabinet having a processing cavity divided into a series of processing stations containing film processing fluid. A pair of support rails extend longitudinally over the processing cavity. A photographic film carrier is loaded at a loading station adjacent to the first bath, and a transport mechanism raises the film above the loading station, transfers it to a position above the bath at the first processing station, and then lowers the carrier such that the photographic film is immersed in the bath. After processing has been completed in the fixed bath, the photographic film assembly is transferred to succeeding processing stations. After the film is raised above the bath at the last processing station, the door of an adjacent drying compartment is opened automatically, and the carrier is set on the portion of the rails which extend into the drying chamber. The door is then reclosed and drying takes place.

14 Claims, 8 Drawing Sheets

FILM PROCESSOR

BACKGROUND OF THE INVENTION

This invention relates to a film processor for developing photographic, x-ray and other related film.

Developing photographic film takes place in a darkroom. The film is developed by placing the film in a series of chemical baths. The time that the film is placed in some of the baths must be controlled within relatively strict limits for proper film development to occur. Furthermore, it is desirable that the film be transported quickly from bath to bath. In general, the time the film remains out of the fluid bath should be minimized. Furthermore, it is often desirable to be able to "jog" the film (that is, move the film for short distances) when it is placed in the bath to break up air bubbles, and it is also desirable to be able to "jog" the film when it is raised out of the bath, to assure that any remaining developing fluid is quickly removed from the film. Furthermore, it is desirable to be able to process more than one set of film negatives at the same time.

SUMMARY OF THE INVENTION

The film processor of the present invention includes a transport mechanism which moves a film carrier between the developing stations or baths by use of a horizontal screw drive, and which raises and lowers the film into the bath at each station by using a vertical screw drive. Each of the horizontal and vertical screw drives are controlled by independent stepper motors which are controlled by a microprocessor. Accordingly, the film carrier can be quickly lowered into the bath at each station, then raised from the bath, and then transported between stations. Accordingly, accurate timing can be effected to control the stepper motors. The transport mechanism is also automatically engaged with and released from the carrier, so that the transport mechanism can return to the loading station to pick up a second carrier while the film carried by the initial carrier is being processed in one of the processing baths. The microprocessor can "jog" the stepper motor controlling the vertical drive screw to permit solution to be removed from the film when the film is lifted out of the bath, and can also jog the film within the bath to break up air bubbles on the film.

BRIEF DESCRIPTION OF THE INVENTION

These and other advantages of the present device will become apparent from the following description, with reference to the accompanying drawings, in which:

FIG. 1 is a view in perspective of a film processor made pursuant to the teachings of the present invention;

FIG. 2, FIG. 3, and FIG. 4 are elevational views, partly in section, taken from one side of the film processor illustrated in FIG. 1, illustrating the manner in which the transport mechanism moves the film carrier and the film carried thereby between the processing stations of the film processor;

DETAILED DESCRIPTION OF THE INVENTION

Figure 1:
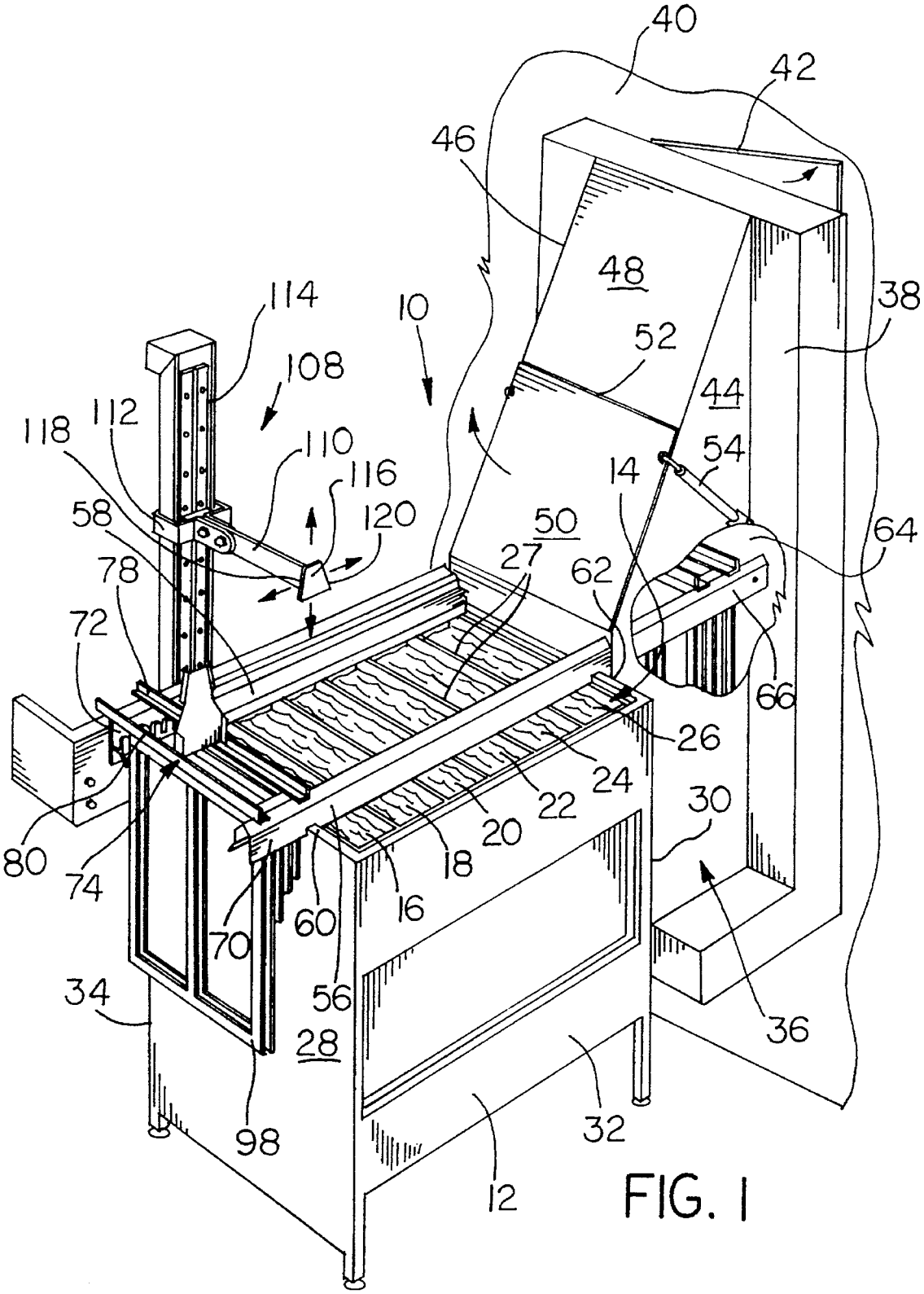
Figure 2:
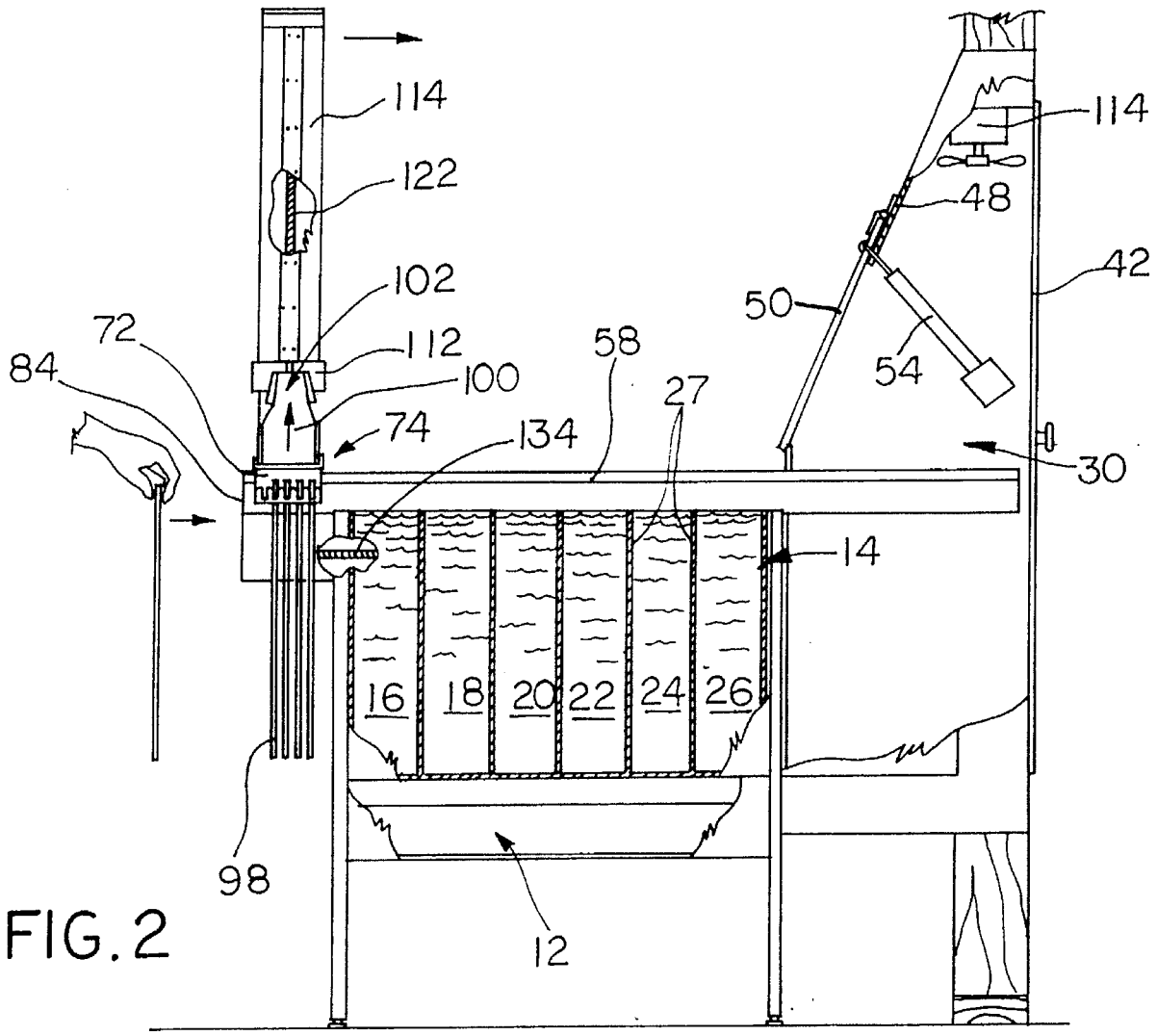

Referring now to the drawings, a film processor generally indicated by the numeral 10 includes a housing or cabinet 12 defining a treatment cavity generally indicated by the numeral 14 which has an open upper surface, the treatment cavity is divided into a series of separated treatment stations or baths 16, 18, 20, 22, 24 and 26 by dividers 28. Although six separate treatment baths or stations are illustrated, it will be understood that any necessary number of treatment stations may be provided as necessary. The number of treatment stations will depend upon the type of film being developed; for example, black and white, color, slide and print film all require different development processes. The treatment cavity 14 is defined between end walls 28, 30, and side walls 32, 34 of the housing or cabinet 12. A drying cabinet generally indicated by the number 36 is mounted on wall 30 of the treatment housing or cavity 12. The drying cabinet is preferably furnished with a facing 38 that extends through a wall 40 which partially defines the darkroom in which the film processor 10 is used. It will be remember that film development normally takes place in a darkroom and that the film processor 10 will be used in such a darkroom. However, it is desirable that developed film may be removed from the processor from outside the darkroom. Accordingly, a door 42 which encloses one end of the drying cabinet 36 may be accessed from outside the darkroom to remove finished photographs, as will hereinafter be described. Drying cabinet 36 further includes side panels 44, 46 and a tapering front panel 48. Front panel 48 includes a swinging door 50 which is connected to the panel 48 by a hinge 52. An actuator 54 is responsive to an electronic control signal to open and close the door 50, as will hereinafter be described.

A pair of longitudinally extending support rails 56, 58 extend substantially parallel to the side walls 32, 34 but are offset therefrom. The rails 56, 58 are supported by the upper surface 60, 62 of the end walls 28, 30 and project beyond the end wall 32 into the drying chamber 64 defined between the panels 44, 46 and 48, the door 50, the facing 38, and the door 42. The portions of the rails 56, 58 projecting into the drying chamber 64 are indicated by reference numerals 66 and 68. Projecting portions 70, 72 project from the end walls 28 to define a loading station which supports a film carrier 74. A stop 76 projects from the rail 58 and is engaged by the carrier 74 to define the loading position of the carrier 74.

Figure 6:
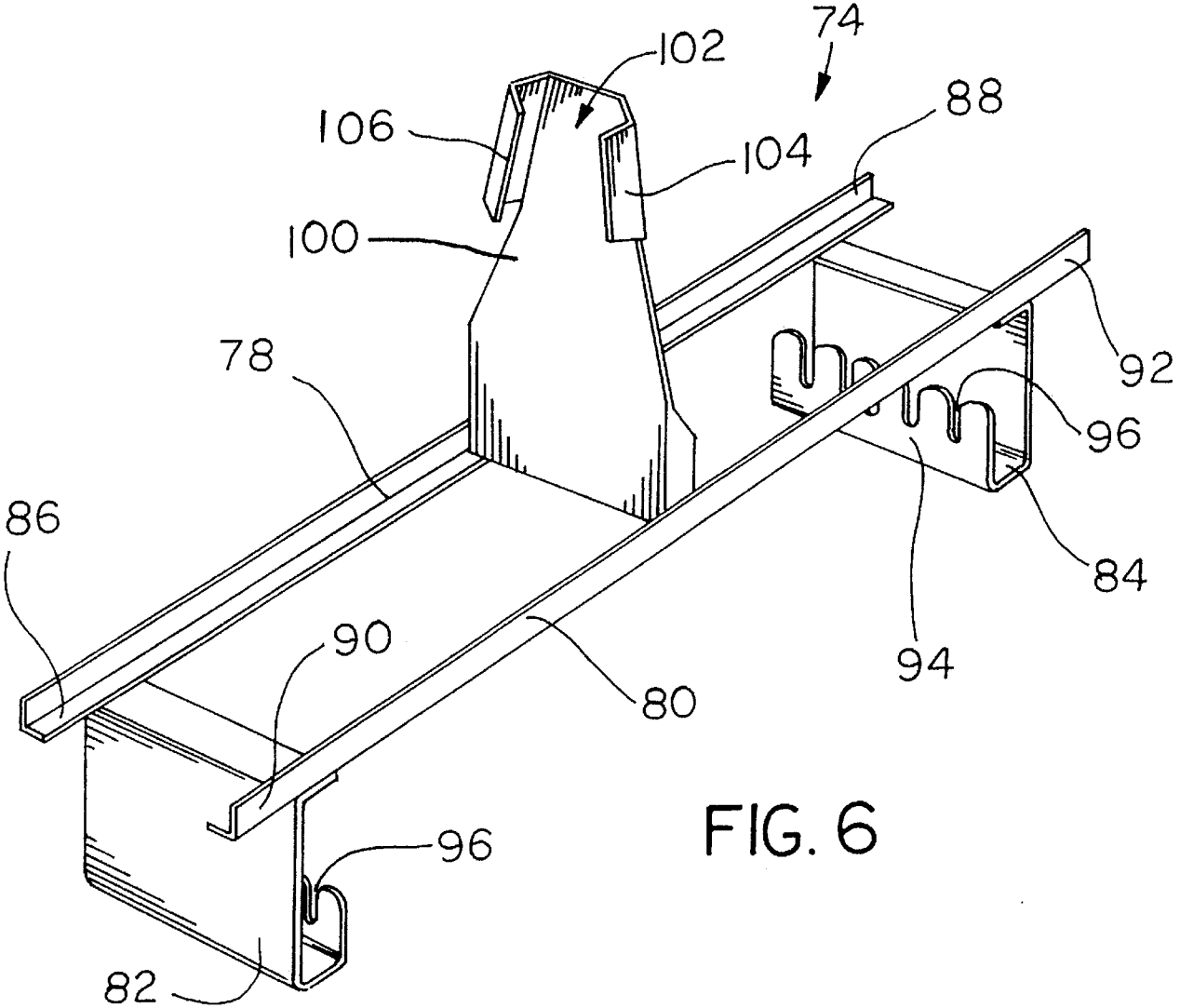
FIG. 6 is a view in perspective of the film carrier used with the film processor illustrated in FIG. 1.
Figure 7:
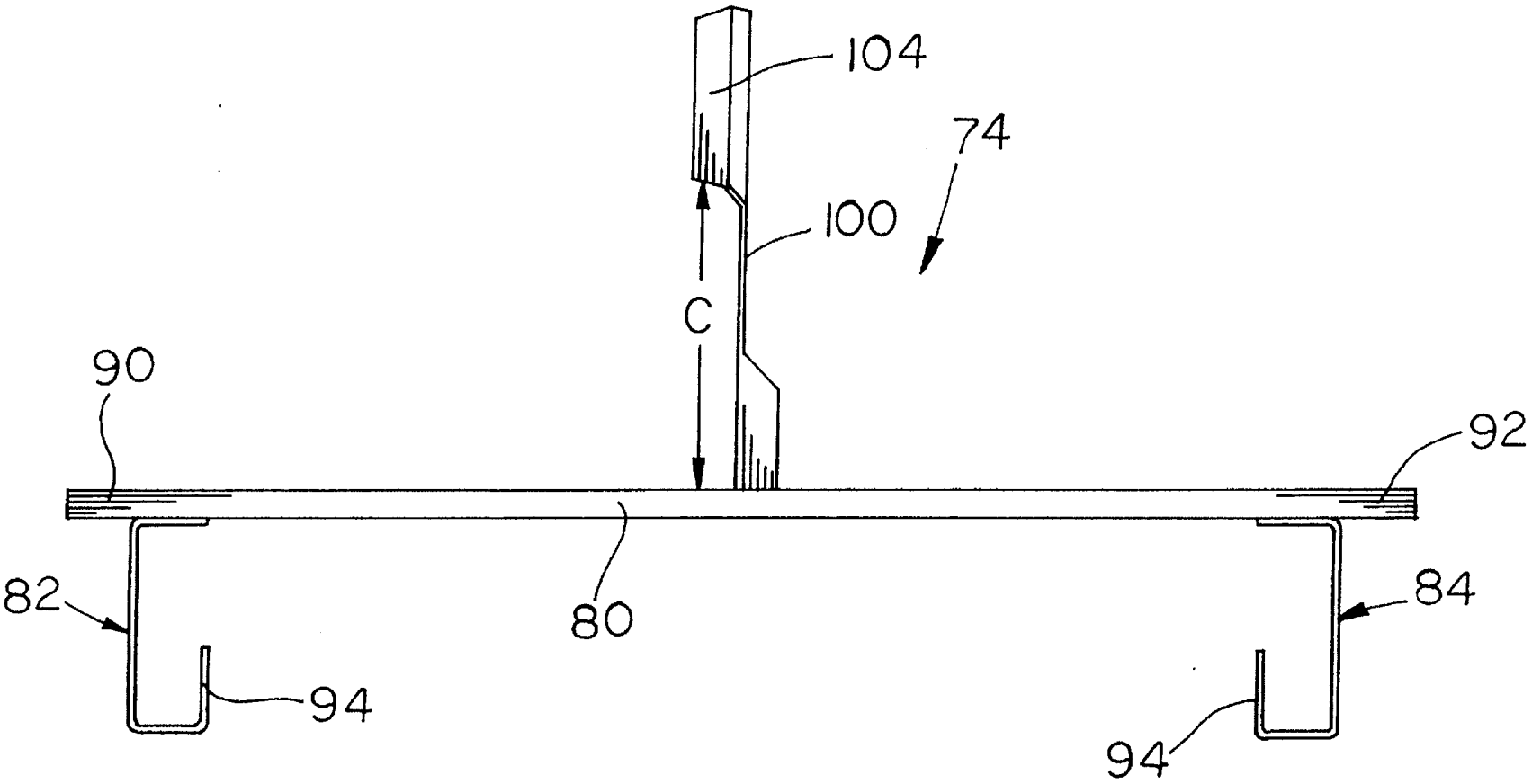
FIG. 7 is a side elevational view of the carrier illustrated in FIG. 6.
Figure 8:
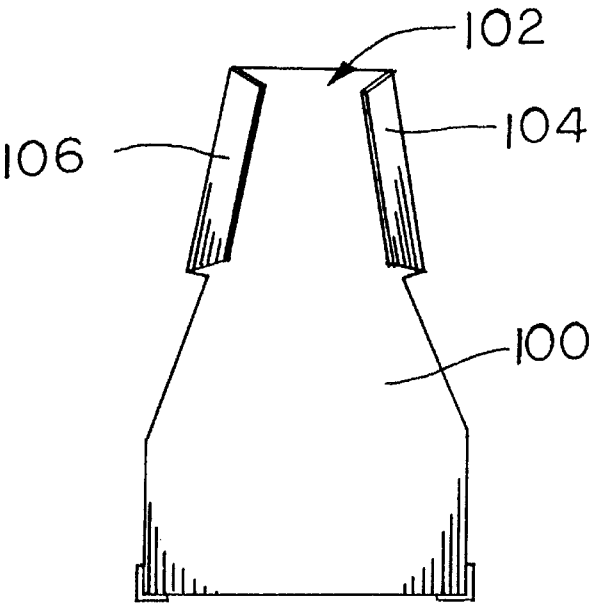
FIG. 8 is a side elevational view of the arm of the carrier illustrated in FIG. 6.

Referring now to FIGS. 6–8, the carrier 74 includes a pair of rails 78, 80 that extend transversely with respect to the rails 56 and 58 when the carrier rests on the rails 56, 58 as indicated in FIGS. 1–4. A pair of support fixtures 82, 84 interconnect the rails 78, 80 adjacent to, but offset from, the ends of the rails 78, 80. Accordingly, the rail 78 defines portions 86, 88 at opposite ends thereof that project beyond the support fixtures 82, 84, and the rail 80 defines similar projecting portions 90, 92. When the carrier is installed on the film processor 10 as indicated in FIGS. 1–4, the projecting portions 86, 90 are supported by rail 58 and the portions 88, 92 are supported by rail 56. Each of the support fixtures 82, 84 include a serrated lip 94 that defines recesses 96 for supporting photographic film carriers 98. Each of the photographic film carriers 98 are supported in a corresponding set of recesses 96, which support photographic film inserts 98. It will be noted that the film inserts 94 all have the same outside dimensions, but may vary with inside dimensions depending on film size. Alternatively, other support fixtures similar to support fixtures 82, 84 may be provided to support roll film from the carrier 74. An upwardly extending carrier arm 100 is secured to each of the rails 78, 80 at their approximate midpoints. The arm 100 terminates in a socket 102, which is defined in part by a pair of tapering arms 104, 106 which taper outwardly toward the rails 78 and 80. Accordingly, the arms 104, 106 are closest together at their upper ends thereof and are furthest apart at their lower ends thereof. The arms 104 and 106 cooperate with the corresponding rails 78 or 80 to define a clearance C there between, for a purpose to be explained hereinafter.

Figure 9:
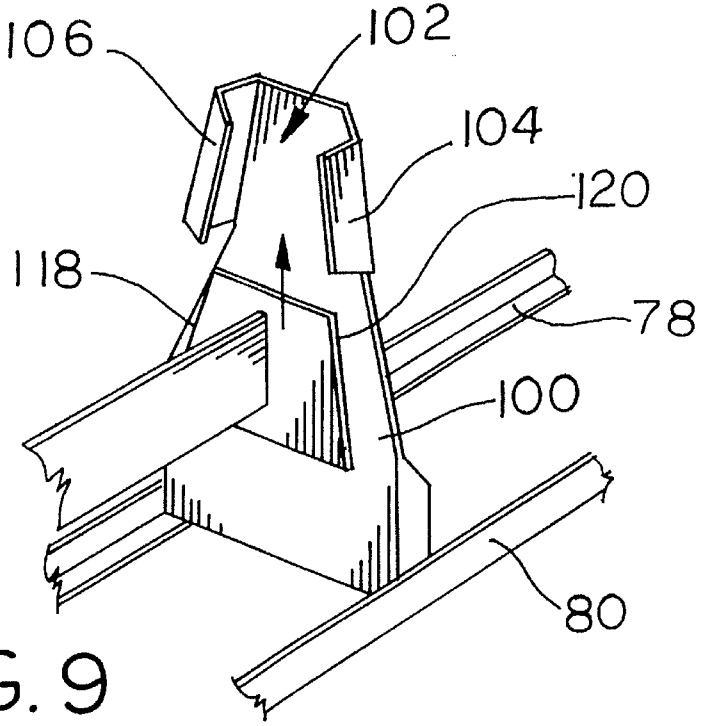
FIG. 9 is a view in perspective illustrating the manner in which the transport arm of the transporting mechanism is engaged and released from the carrier arm of the film carrier.

The carrier 74 is transported between the loading station, the treatment stations 16–24, and the drying chamber 64 by a transport mechanism generally indicated by the numeral 108. The transport mechanism is generally indicated by numeral 108. The transport member 108 includes a transport arm 110 which is secured to a slide member 112 which reciprocates vertically on an upright tract 114. The arm 110 terminates in a vertically extending flange 116 which includes a pair of upwardly converging sides 118, 120, which, as most clearly illustrated in FIG. 9, are received within the socket 102 and engaged with the arms 106 and 104. The flange 120 is initially moved laterally, as will hereinafter be described, through the clearance C when the arm 110 is lowered on the tract 114 to its lowermost position. The arm, after passing through the clearance C, moves the flange 120 upwardly to engage the socket 102, thereby permitting the arm 110 to lift the carrier and the photographic film supported thereby out of one station and subsequently lowering it into another station. Accordingly, the arm 110 constitutes an insertion drive for inserting and removing photographic film into and out of the various stations. The slide 112 is raised and lowered on the upright tract 114 by rotation of a drive screw 122 which is journaled for rotation at its opposite ends 124 and 126 relative to the tract 114. An electric stepper motor 128 is carried by the tract 114 for rotating the screw 122. A drive nut 130 within slide 112 is threadedly connected to the drive screw 122, whereupon rotation of the drive screw 122 in one direction raises the slide 112 and therefore the arm 110, and rotation of the drive screw 122 in the opposite direction lowers the slide 112. The upright tract 114 is slidably mounted on a lateral tract generally indicated by the numeral 132. The upright tract is mounted on the lateral tract 132 using a sliding collar (not shown) similar to the sliding collar 112. A nut (not shown) carried by the sliding collar is threadably connected to rotatable drive screw 134. Drive screw 134 is mounted for rotation relative to the lateral tract 132 as at 136 and 138. A stepper motor 140 similar to the stepper motor 128 rotates the drive screw 134 in either direction to thereby move the upright tract 114 between the treatment stations. A microprocessor 142 is connected to the stepper motors 128 and 140 and to the actuator 54 for controlling these devices as will hereinafter be described.

Figure 3:
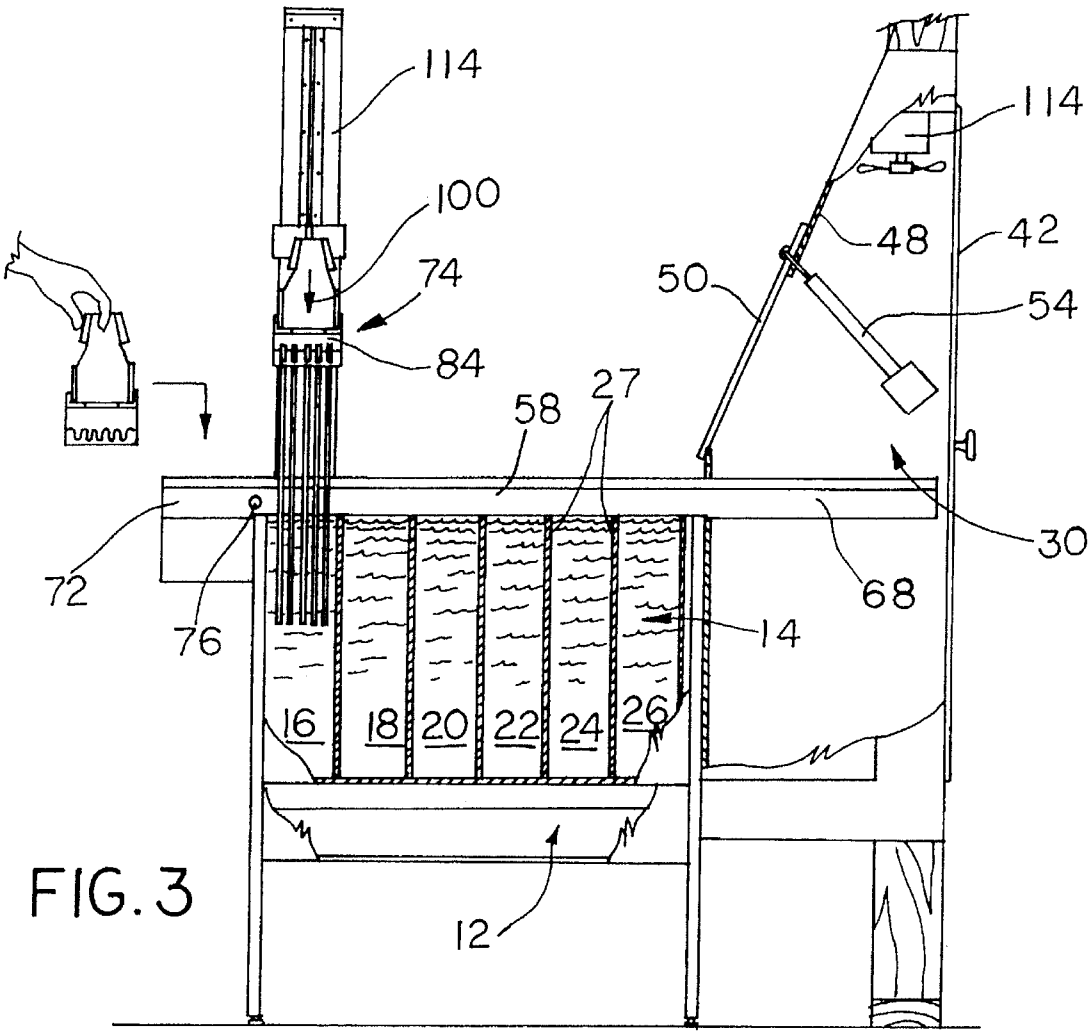

In operation, the darkroom operator loads film on photographic film inserts 98 and installs the photographic film inserts in the recesses 96 of the carrier 74. The carrier 74 is then placed on the loading station defined by the extension 70, 72 of the rails 56, 58 with the rail 78 of the carrier 74 engaged with the stop 76. The microprocessor is then actuated to initiate the processing sequence. When this occurs, the microprocessor 142 operates the stepper motor 140 to bring the upright tract 114 to the loading station. The drive screw 122 is then rotated by stepper motor 128 to lower the arm 110 carrying the flange 116. The tract 114 is then again moved a small distance to move the flange 116 through the clearance C. The screw 122 is then rotated by stepper motor 128 in the opposite direction to elevate the carrier 74, and the photographic film inserts 98 attached thereto, above the loading station such that the rails 78 and 80 will be lifted off of the rails 56 and 58. The stepper motor 140 is then operated to rotate the drive screw 134 to thereby advance the upright tract 114 away from the loading station to a position above the first processing station 16. Screw 122 is then turned by stepper motor 128 to lower the carrier 74 and the photographic film inserts 98 into the processing bath at the first processing station 16, as illustrated in FIG. 3. After the photographic film inserts are immersed in solution, conventional air jets (not shown) may be operated to agitate the processing fluid in the processing station 16, and the stepper motor 128 may be operated first in one direction and then in the other direction briefly to "jog" the film inserts within the bath at processing station 16 to thereby break up any bubbles that may remain in the bath. After a predetermined time period has elapsed, the microprocessor 142 causes actuation of the stepper motor 128 and consequent rotation of screw 122 to elevate the carrier 74, and therefore the photographic film inserts 98, above the bath at processing station 16. After the carrier has been raised, the microprocessor 142 may again operate motor 128 briefly in both directions to "jog" the carrier 74 to remove excess fluid that may have adhered to the photographic film inserts 98. The microprocessor 142 then operates stepper motor 140 to rotate the screw 134 to advance the carrier 74 from processing station 16 to processing station 18.

Figure 4:
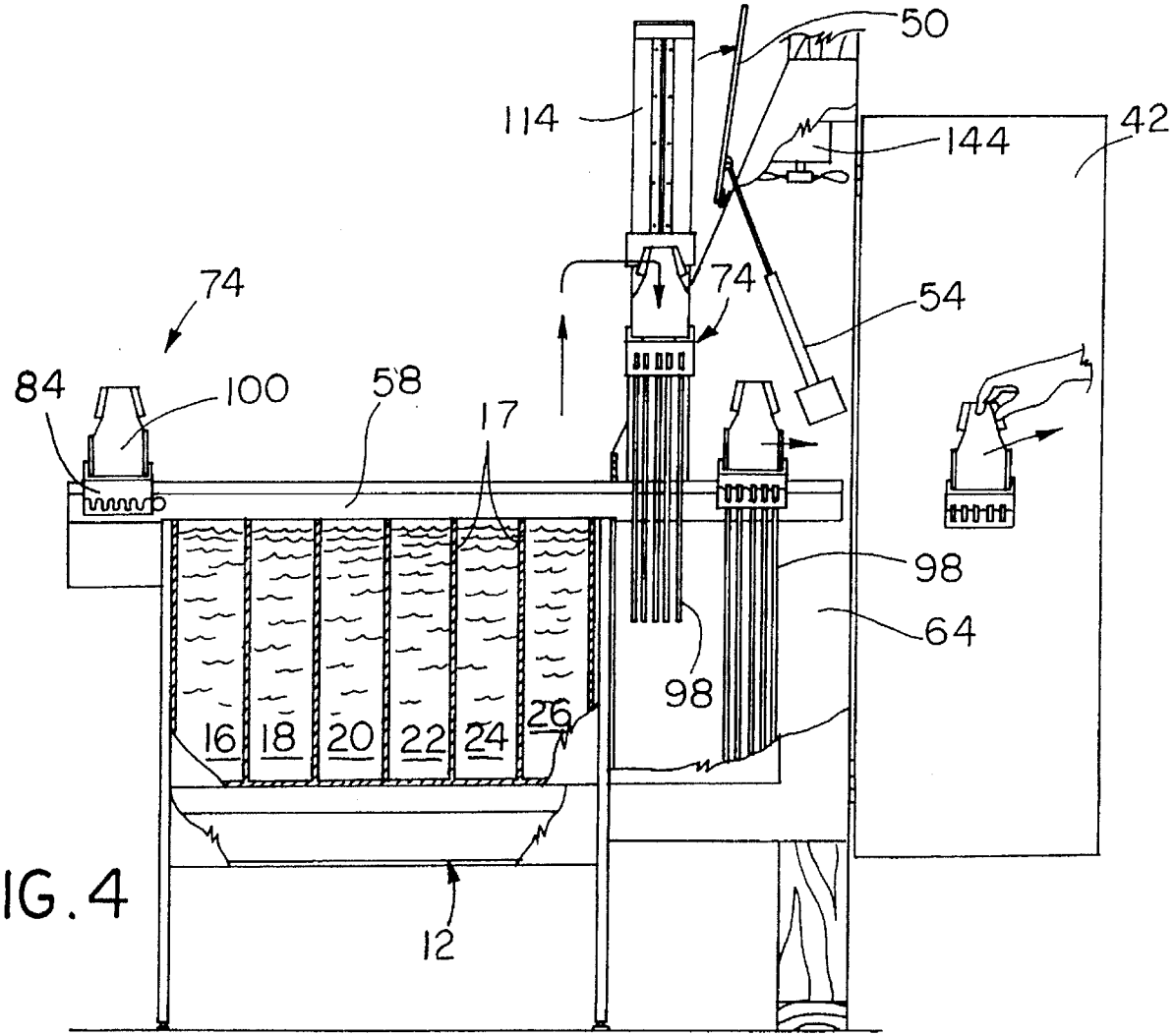
Figure 5:
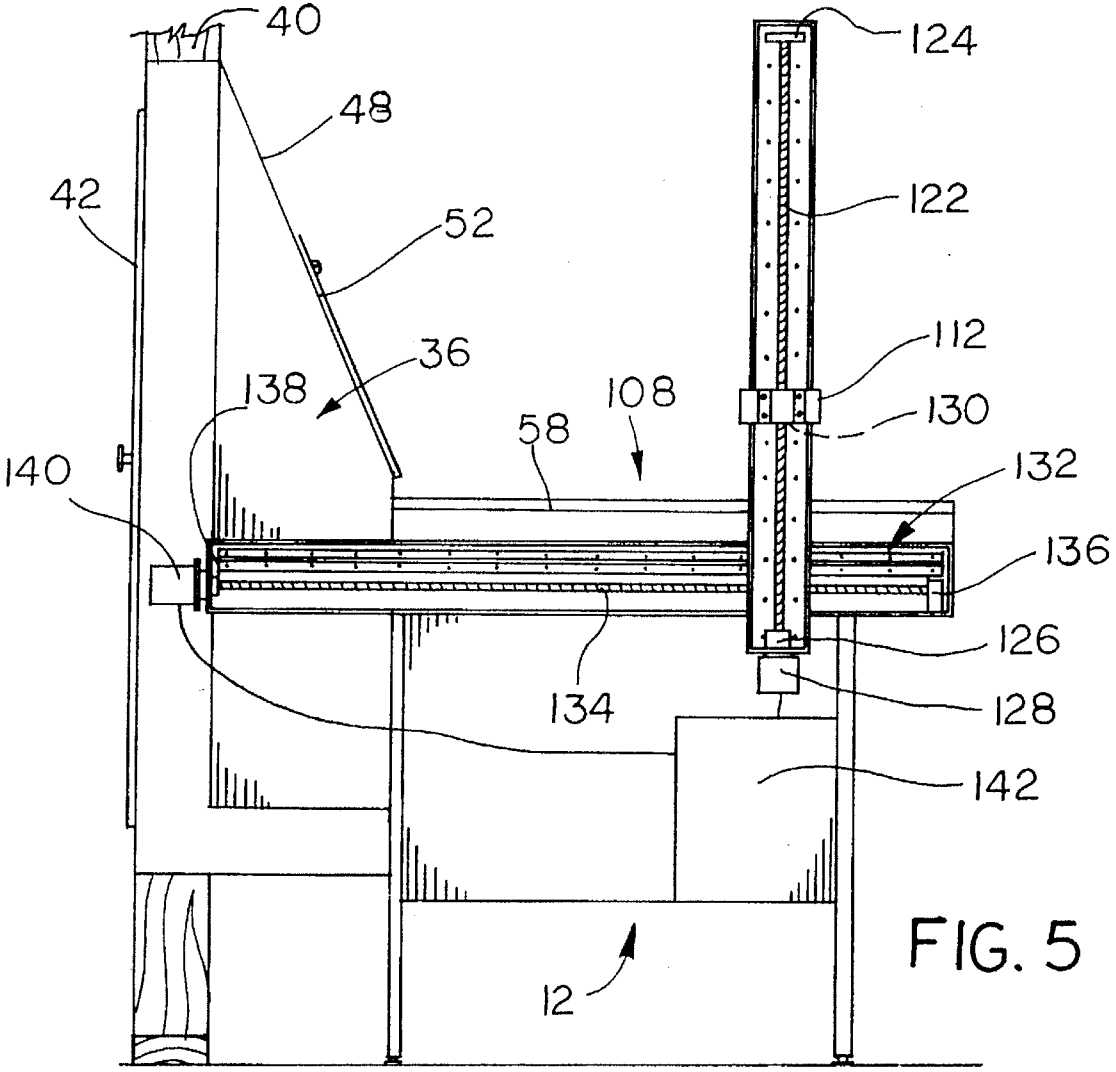
FIG. 5 is an elevational view of the film processor taken from the opposite side of the film processor illustrated in FIG. 1.

After the carrier 74 has been transported to a position over the station 18, the microprocessor 142 again actuates the stepper motor 128 to lower the film inserts in the processing bath at station 18. This is repeated until the photographic film inserts have been immersed in each of the succeeding baths. After processing has been completed in the bath at processing station 26, the actuator 54 is operated to open the door 50. At the same time, an interlock is latched to prevent door 42 from being opened. As illustrated in FIG. 4, the carrier 74 is lowered within the drying compartment or chamber 64 until the rail 78 of the carrier rests on the extensions 66, 68 of the rails 56, 58 within the drying chamber 64. The microprocessor then operates actuator 54 to reclose door 50, and drying fan 144 is then operated to effect drying of the film inserts. When drying is completed, the interlock holding door 42 closed is released, permitting the operator in the adjacent room to remove the carrier 74 with its photographic film inserts 98. In the meantime, the operator within the darkroom is able to load another carrier of photographic film inserts, and the process is repeated.

After one set of photographic film inserts has been deposited in the bath at station 20 or one of the later stations 20 or 24, double batch processing can be initiated. After the carrier has been lowered into position above station 20, the arm 110 is moved downwardly to permit the flange 16 to move through the clearance C. The upright tract 114 is then caused to be moved back to the loading station where it picks up another carrier 74 and deposits the film inserts loaded thereon into the bath at station 16. The flange 16 can then be released from the socket. The upright track 114 is then retained to station 22 to transfer the carrier to the next station. It must be recognized that the time that the film inserts are immersed in the bath at the initial station 16 is absolutely critical. Accordingly, time out at this station must have priority in double batch processing over time out of the film inserts in any of the baths at the other stations. It is advisable to wait until the film inserts have at least been immersed into the third bath at station 20 before double batch processing is initiated, because having carriers above adjacent station may result in fluid from one station dripping on film inserts as they are raised from another station, which is obviously undesirable.

The processor is capable of doing selective continuous processing. While most operators may not be able to keep loading process during machine operation, they may preload film inserts, or via a longer time base in tank choose to do so. This affords a very valuable function to some operators who need high production.

I claim:

1. Film processor comprising a housing, said housing defining a loading station and multiple treatment stations, a carrier member for supporting film, a transport member movably mounted on said housing for moving said carrier member between said stations, insertion drive means for causing said transport member to move said carrier member into and out of said stations, and transport drive means for moving said transport member and said carrier member between said stations, said transport member including a transport arm for engaging said carrier member when the carrier member is to be transported from one station to another station, said insertion drive means including an upright track carried by the housing slidably supporting said transport arm for movement along said track toward and away from said treatment stations, first power actuating means for moving said transport arm along said upright track, a lateral track for moving said upright track from one of said stations to another of said stations, and second power actuating means for moving said upright track along said lateral track.

2. Film processor as claimed in claim 1, wherein one of said treatment stations is a drying station.

3. Film processor as claimed in claim 1, wherein control means operates said first and second power actuating means, said control means including first means for operating said second power actuating means to transport said carrier from said loading station to one of said treatment stations, and second means for operating said first power actuating means to move the carrier to a position inserting the film into the treatment station.

4. Film processor as claimed in claim 3, wherein said control means includes timing means for causing said first power actuating means to remove the film from said one treatment station and causing said first and second power actuating means to transfer said carrier with said film to another treatment station.

5. Film processor as claimed in claim 4, wherein said control means includes means for causing said first and second power actuating means to return said upright track to the loading station after the carrier has been transferred to a processing station other than the first processing station to transfer a second carrier to the first processing station.

6. Film processor as claimed in claim 1, wherein said first and second power actuating means each include a screw drive, and a drive motor for turning said screw drive.

7. Film processor as claimed in claim 1, wherein said first power actuating means includes a first drive screw mounted on said upright track for rotation relative thereto, first connection means for drivingly connecting said transport arm to said first drive screw to thereby drive said transport arm along said upright track in response to rotation of the first drive screw, said second power actuating means including a second drive screw mounted on said lateral track for rotation relative thereto, second connection means for drivingly connecting said upright track to said second drive screw to thereby move said upright track along said lateral track, each of said first and second power drive means including power means tier rotating said screws.

8. Film processor as claimed in claim 1, wherein said first power actuating means includes a drive screw mounted on said upright track for rotation relative thereto, connection means for drivingly connecting said transport arm to said drive screw to thereby drive said transport arm along said upright track in response to rotation of the drive screw, and power means for rotating the drive screw.

9. Film processor as claimed in claim 1, wherein said first power actuating means includes a drive screw, connection means for drivingly connecting the transport member to the drive screw for moving the transport member by rotation of the drive screw, and a motor for rotating the drive screw.

10. Film processor as claimed in claim 1, wherein said second power actuating means includes a drive screw, connection means for drivingly connecting the transport member to the drive screw for moving the transport member by rotation of the drive screw, and a motor for rotating the drive screw.

11. Film processor comprising a housing, said housing defining a loading station and multiple treatment stations, a carrier member for supporting film, a transport member movably mounted on said housing for moving said carrier member between said stations, insertion drive means for causing said transport member to move said carrier member into and out of said stations, and transport drive means for moving said transport member and said carrier member between said stations, said insertion means including a first drive screw, first connection means for drivingly connecting the transport member to the first drive screw for moving the transport member by rotation of the drive screw, and a first motor for rotating the first drive screw, and said transport drive means includes a second drive screw, second connection means for drivingly connecting the transport member to the second drive screw for moving the transport member by rotation of the second drive screw, and a second motor for rotating the second drive screw.

12. Film processor comprising a housing, said housing defining a loading station and multiple treatment stations, a carrier member for supporting film, a transport member movably mounted on said housing for moving said carrier member between said stations, insertion drive means for causing said transport member to move said carrier member into and out of said stations, and transport drive means for moving said transport member and said carrier member between said stations, said transport member and said carrier member including cooperating engagement means for coupling the carrier member to the transport member for transport thereby, said cooperating engagement means including means responsive to relative movement between the transport member and the carrier member for coupling and uncoupling the transport member and the carrier member, said cooperating engagement means including a socket mounted on one of said members and a flange on the other member for engagement with said socket when the transport member is moved to a position engaging the flange with the socket, and said carrier member including an upwardly projecting carrier arm and said transport member including a transport arm, said socket being secured to one of said arms and the flange being secured to the other arm to thereby couple the transport arm to the upwardly projecting arm when the carrier member is to be moved and to uncouple the arms after the carrier member has been moved.

13. Film processor as claimed in claim 12, wherein said housing supports a pair of rails traversing said stations, said carrier including a base for supporting film, said base being supported by the rails, said insertion drive means lifting said carrier off of the rails when the carrier is to be transported to another station.

14. Film processor as claimed in claim 13, wherein said socket is mounted on said carrier arm and defines a clearance with said base, said flange being mounted on the transport arm and traversing said clearance when the transport arm engages the carrier arm.

* * * * *